US010654053B2

(12) United States Patent
Otoguro

(10) Patent No.: US 10,654,053 B2
(45) Date of Patent: May 19, 2020

(54) FOAMED WATER DISCHARGING DEVICE AND FOAMED WATER DISCHARGING UNIT

(71) Applicant: Toshin Inc., Nagoya-shi, Aichi (JP)

(72) Inventor: Koichi Otoguro, Yamanashi (JP)

(73) Assignee: Toshin Inc., Nagoya-Shi, Aichi-Ken (JP)

( * ) Notice: Subject to any disclaimer, the term of this patent is extended or adjusted under 35 U.S.C. 154(b) by 173 days.

(21) Appl. No.: 15/878,586

(22) Filed: Jan. 24, 2018

(65) Prior Publication Data

US 2018/0147584 A1 May 31, 2018

Related U.S. Application Data

(63) Continuation of application No. 15/317,568, filed as application No. PCT/JP2016/061096 on Apr. 5, 2016, now abandoned.

(30) Foreign Application Priority Data

Aug. 19, 2015 (JP) ..... 2015-161871

(51) Int. Cl.
*B05B 7/00* (2006.01)
*E03C 1/084* (2006.01)

(52) U.S. Cl.
CPC ..... *B05B 7/005* (2013.01); *E03C 1/084* (2013.01)

(58) Field of Classification Search
CPC ..... B05B 7/005; B05B 7/0018; B05B 7/0081; B05B 7/0087; B05B 7/04; B05B 7/0416;
(Continued)

(56) References Cited

U.S. PATENT DOCUMENTS 3,239,152 A * 3/1966 Bachli ..... E03C 1/084 239/431
3,745,994 A * 7/1973 Kane ..... A61H 33/027 601/169

(Continued)

FOREIGN PATENT DOCUMENTS

EP 0646680 A1 4/1995
EP 1273724 A1 1/2003

(Continued)

OTHER PUBLICATIONS

International Search Report on International Application PCT/JP2016/061096.
Written Opinion on International Application PCT/JP2016/061096.

*Primary Examiner* — Chee-Chong Lee
*Assistant Examiner* — Christopher R Dandridge
(74) *Attorney, Agent, or Firm* — Browdy and Neimark, PLLC

(57) ABSTRACT

A foamed water discharging device includes a water feeding hole, a water discharging hole, a water passage, a ventilation passage, and a foamed water generator. The water passage has a cylindrical inner circumferential surface extending from the water feeding hole to the water discharging hole. The ventilation passage takes in external air on the upstream side of the water passage. The foamed water generator causes water containing the external air to undergo a collision on the downstream side of the water passage so as to convert the water into foamed water. The foamed water generator includes flow dividing ribs along the inner circumferential surface of the water passage, which protrude radially toward the center of the water passage. On a top portion of each flow dividing rib, at least a pair of inclined
(Continued)

surfaces are formed to divide, rightward and leftward, water inflowing from a water guiding passage through the water feeding hole.

15 Claims, 15 Drawing Sheets

(58) Field of Classification Search
CPC ..... B05B 7/0425; E03C 1/08; E03C 1/084; E03C 1/086
USPC ..... 239/428.5
See application file for complete search history.

(56) References Cited

U.S. PATENT DOCUMENTS 4,562,960 A * 1/1986 Marty ..... G05D 7/012 239/72
5,495,985 A 3/1996 Nehm et al.
6,708,902 B2 3/2004 Takeshi et al.
7,357,337 B2 * 4/2008 Ferrari ..... E03C 1/08 239/428.5
7,677,473 B2 * 3/2010 Kao ..... E03C 1/084 239/428.5
2003/0029935 A1 2/2003 Takeshi et al.
2006/0011748 A1 1/2006 Ferrari et al.
2010/0163478 A1 * 7/2010 Yuan ..... B01D 36/04 210/251
2010/0213283 A1 8/2010 Staedtler
2016/0060853 A1 * 3/2016 Shapiro ..... E03C 1/0404 137/614.2

FOREIGN PATENT DOCUMENTS

EP 1273724 B1 1/2004
JP 07166588 A 6/1995
JP 1474632 B2 6/2010
JP 201272594 A 4/2012

* cited by examiner

[Fig. 1]
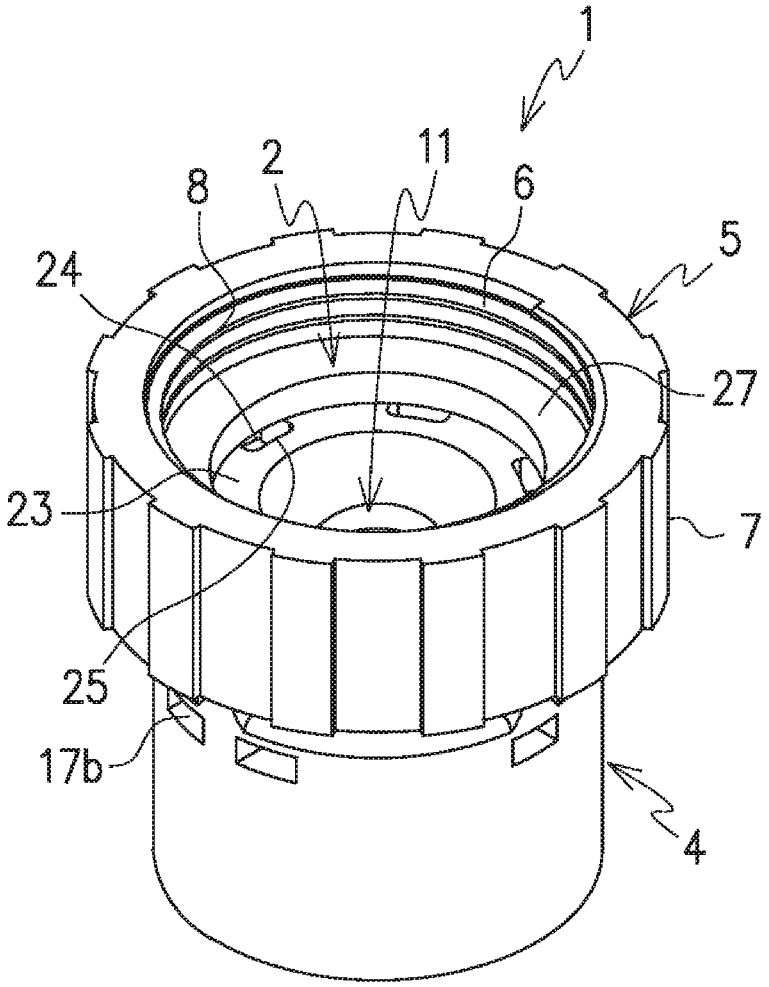

[Fig. 2]
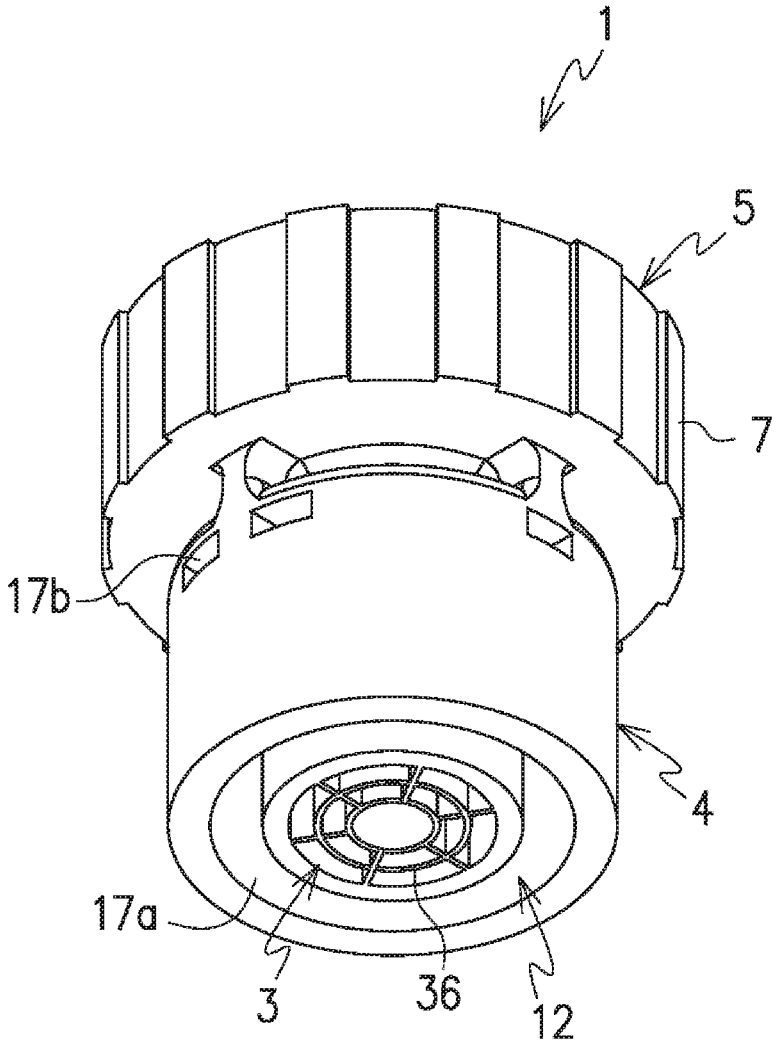

[Fig. 3]
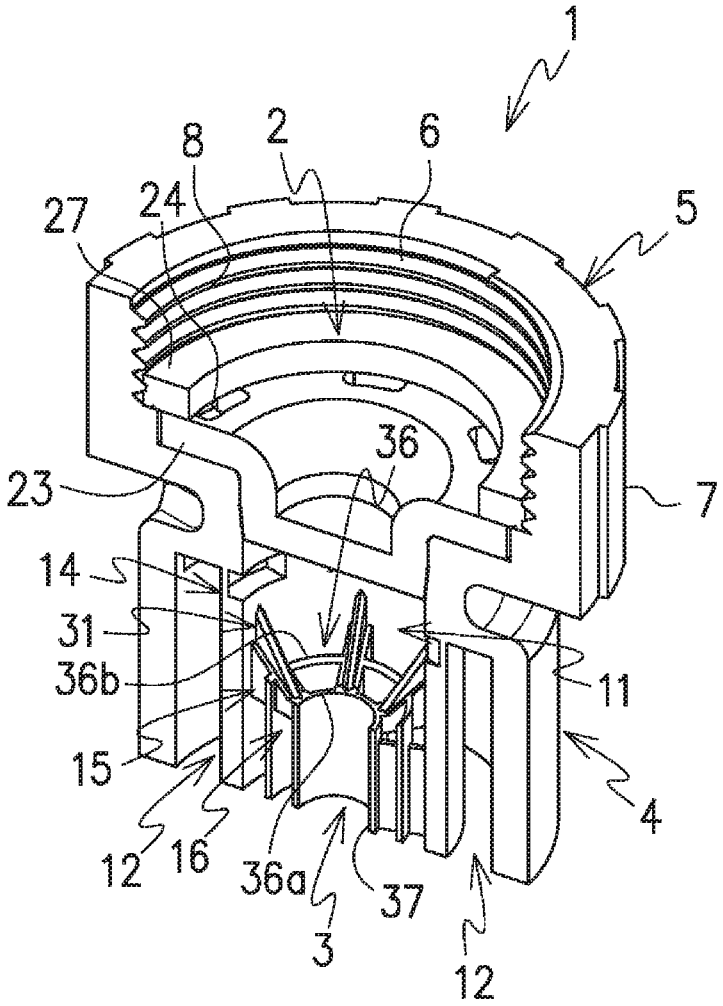

[Fig. 4]
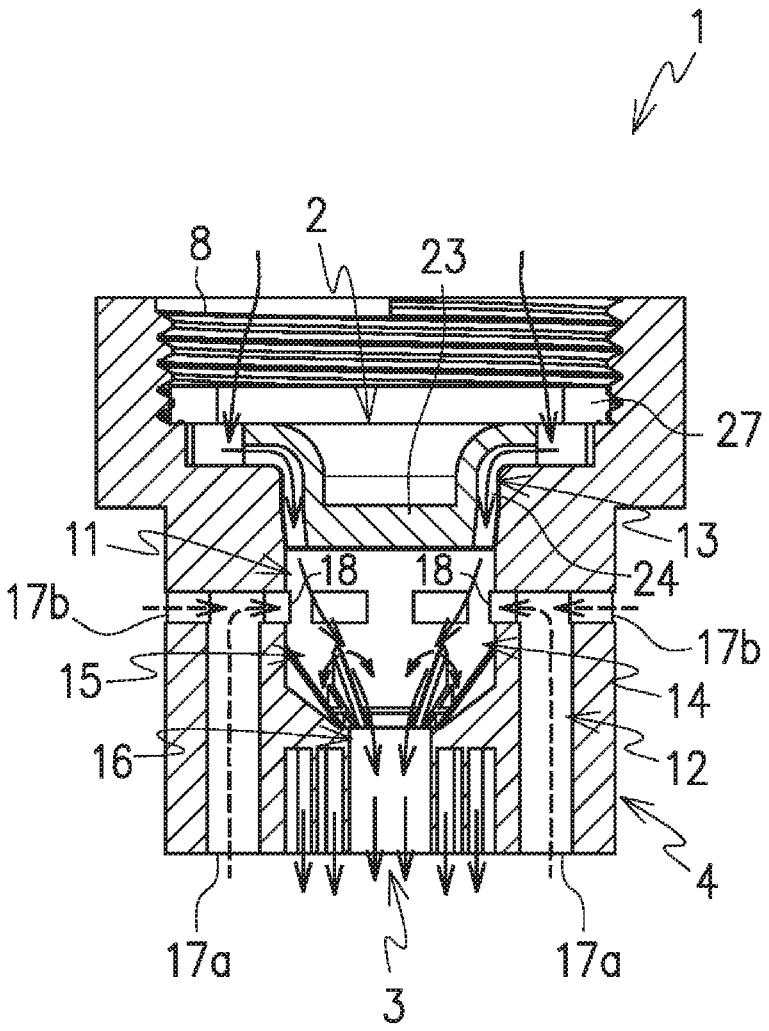

[Fig. 5]
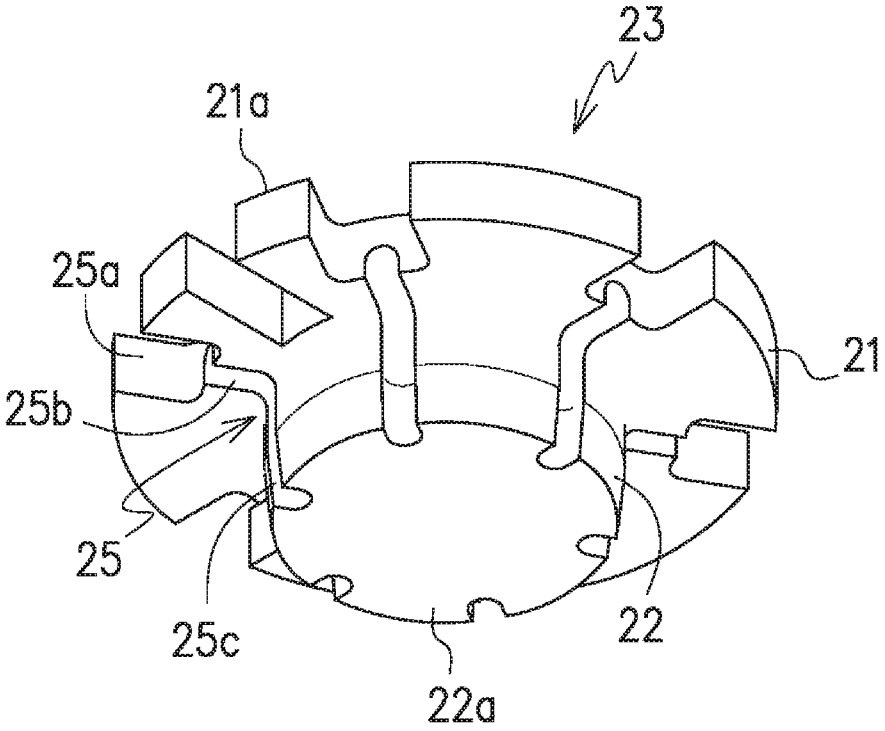

[Fig. 6]
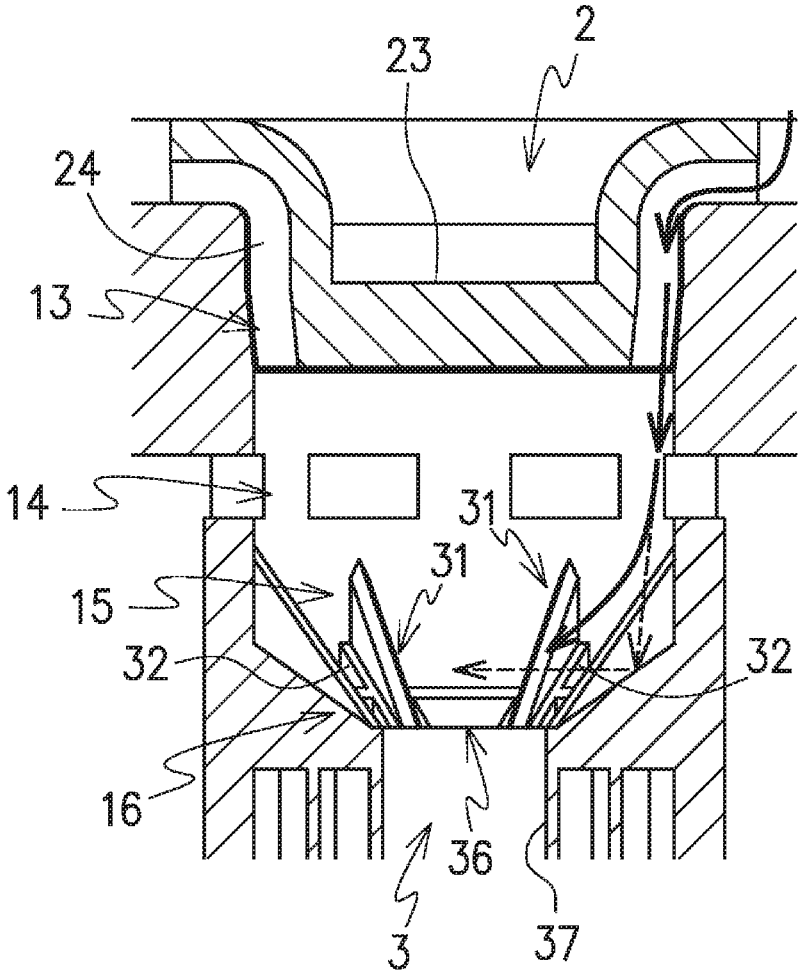

[Fig. 7]
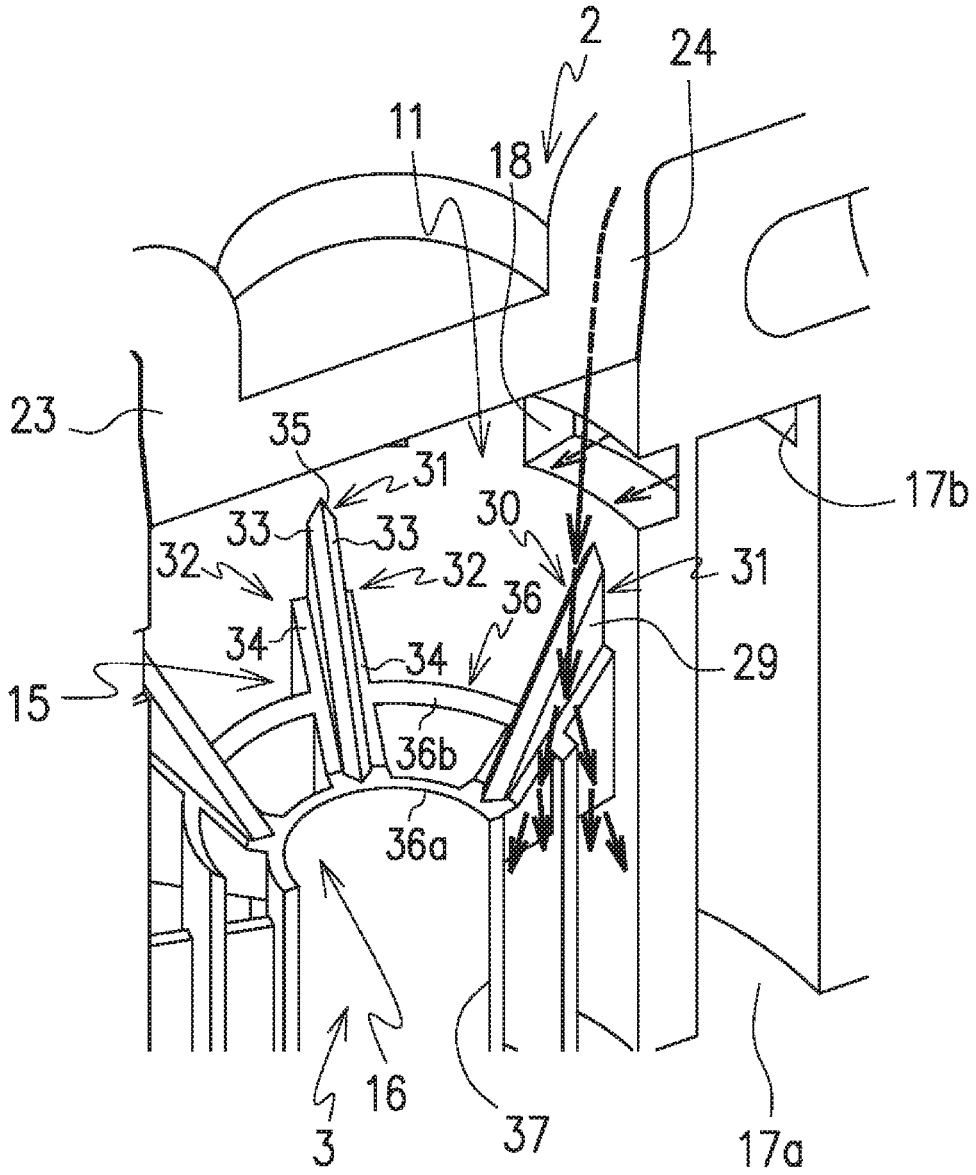

[Fig. 8]
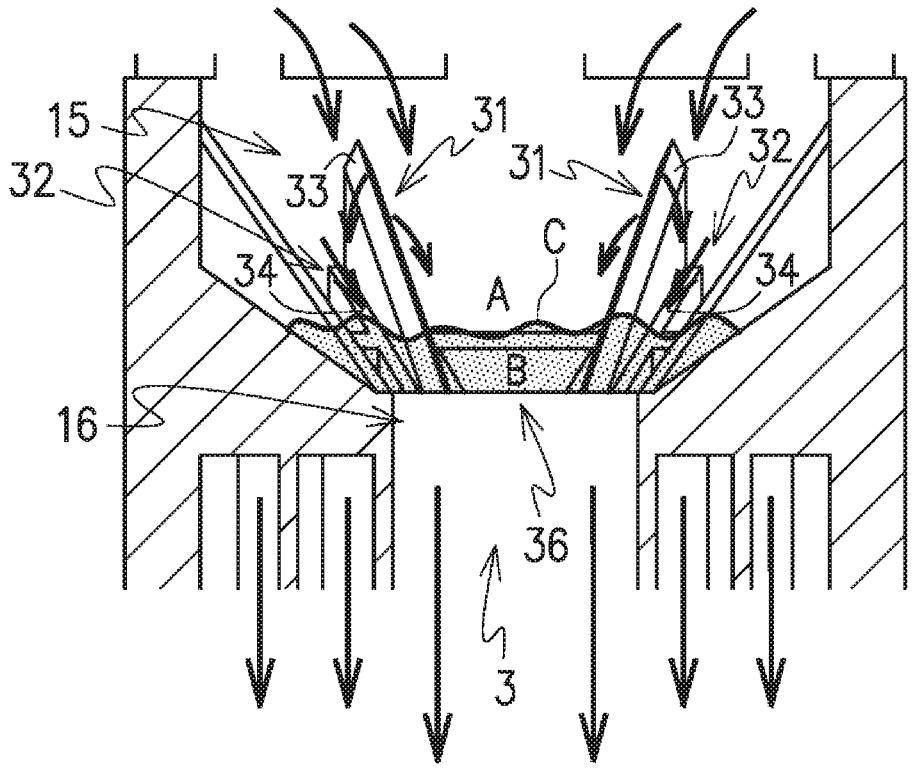

[Fig. 9]
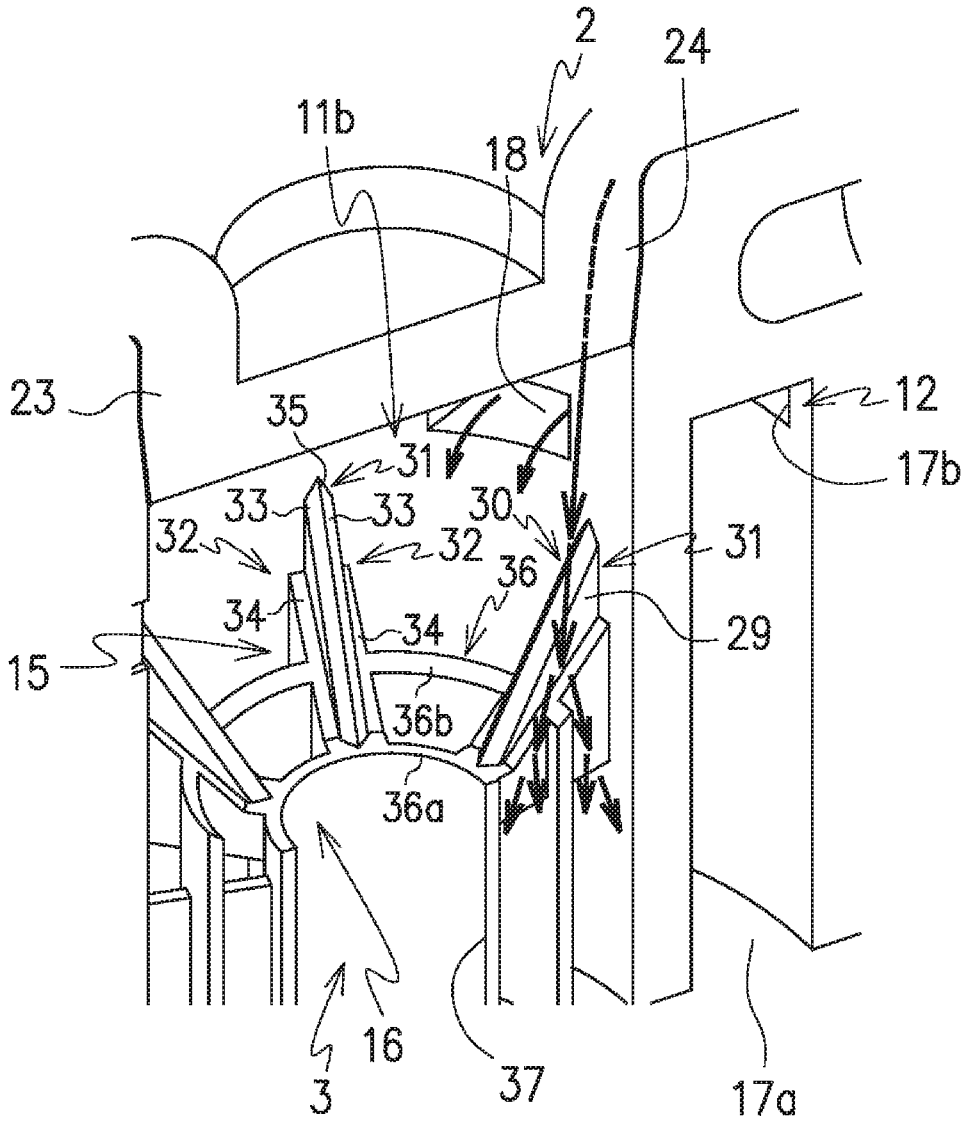

[Fig. 10]
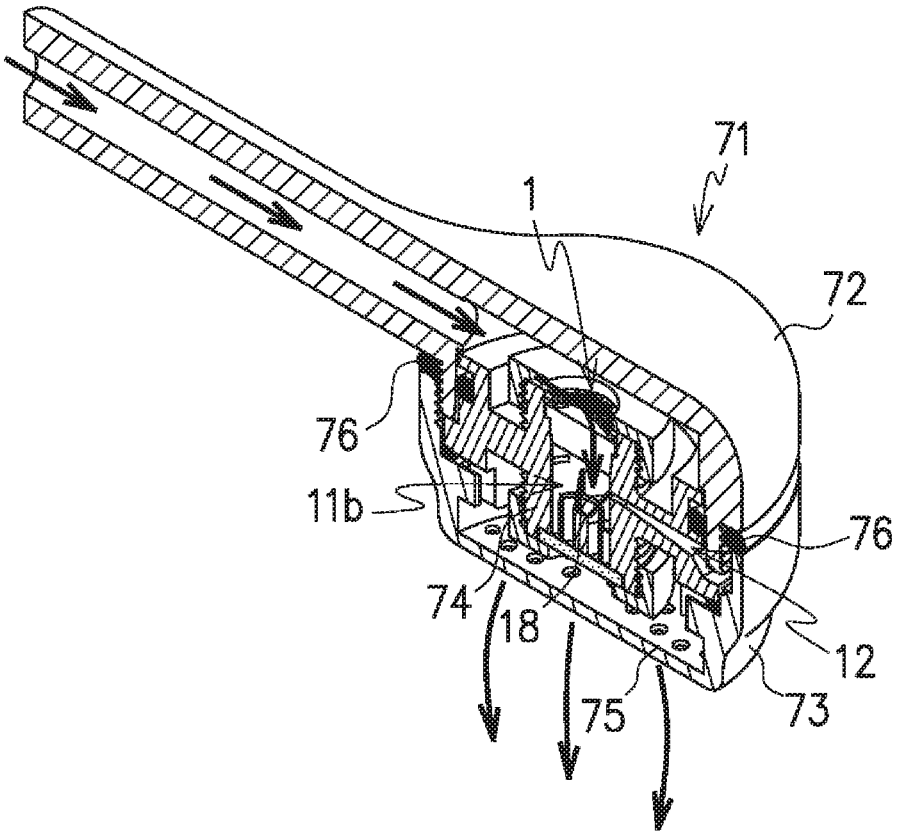

[Fig. 11]
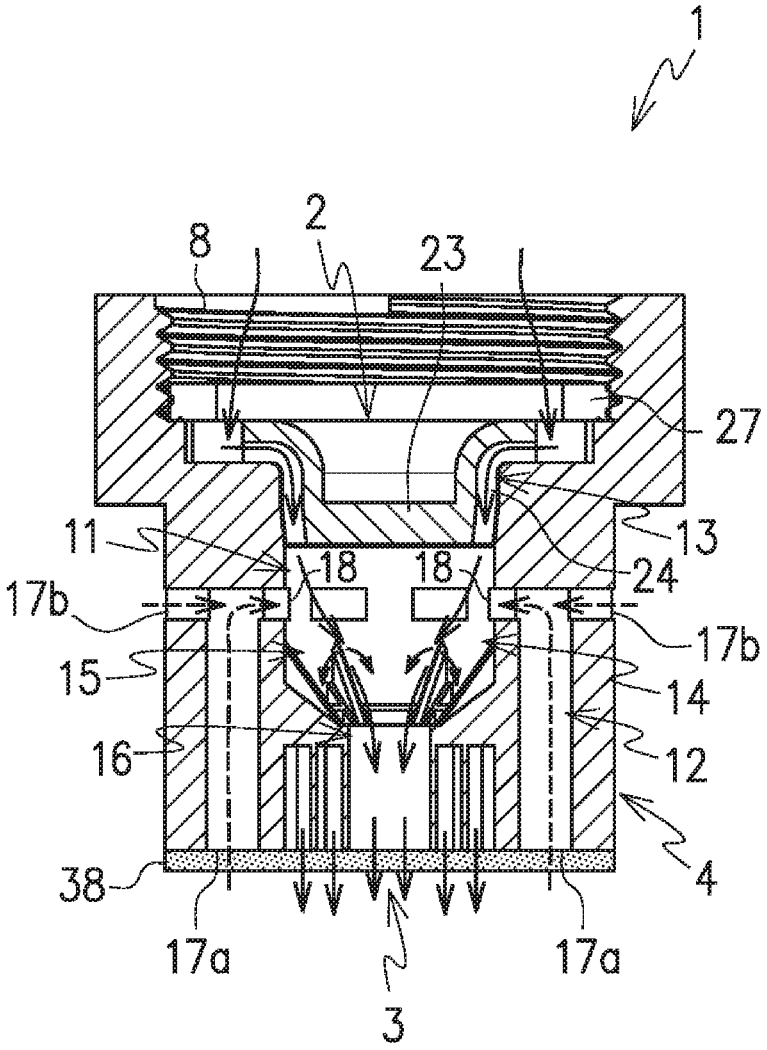

[Fig. 12]
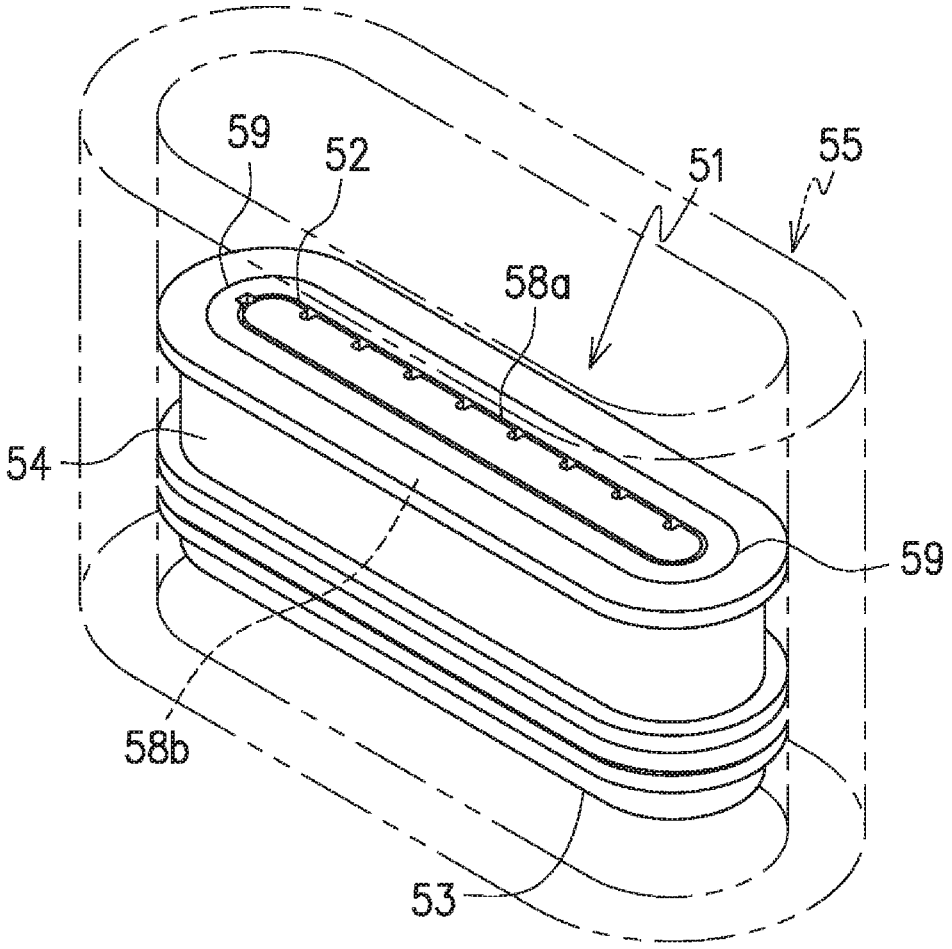

[Fig. 13A]
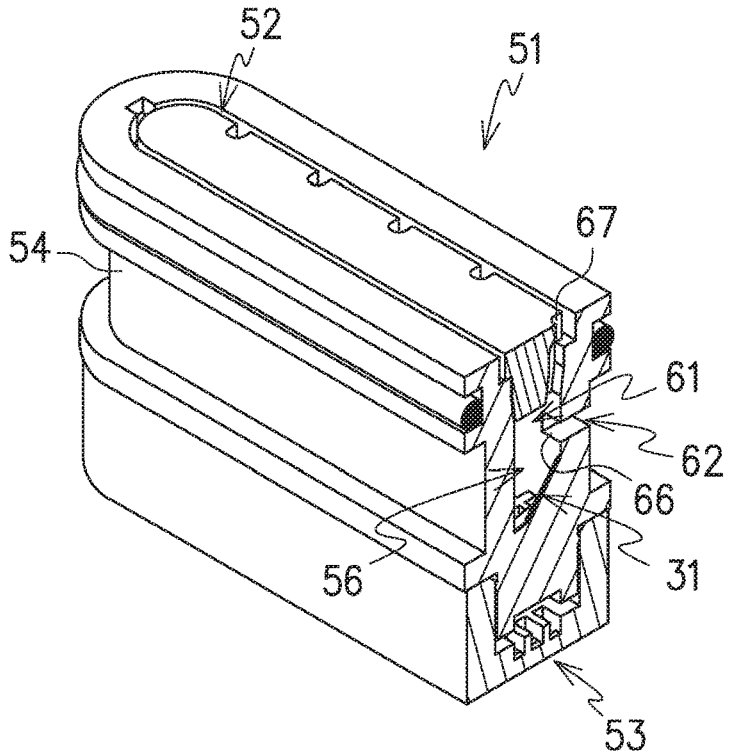
[Fig. 13B]
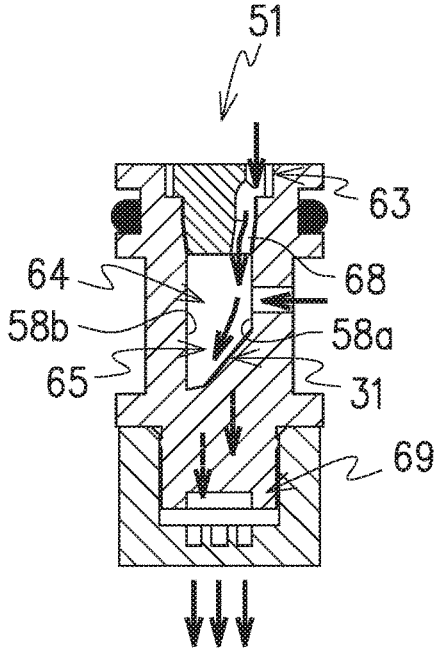

[Fig. 14A]
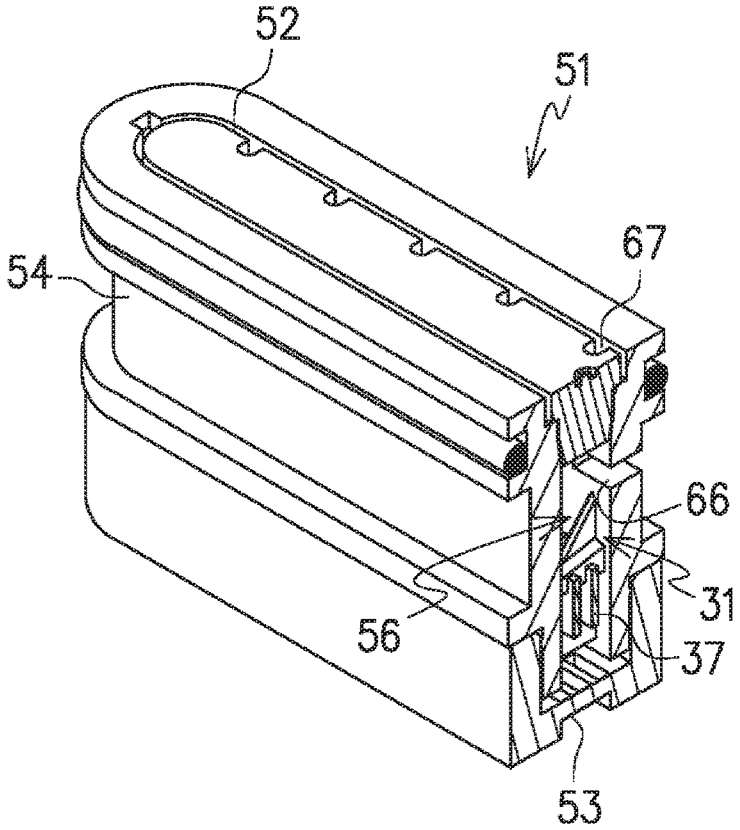
[Fig. 14B]
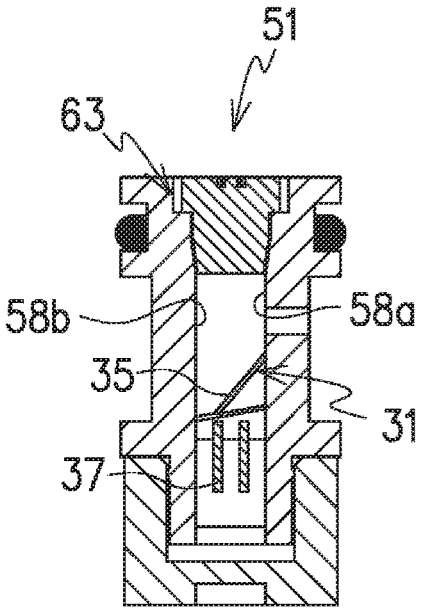

[Fig. 15A]
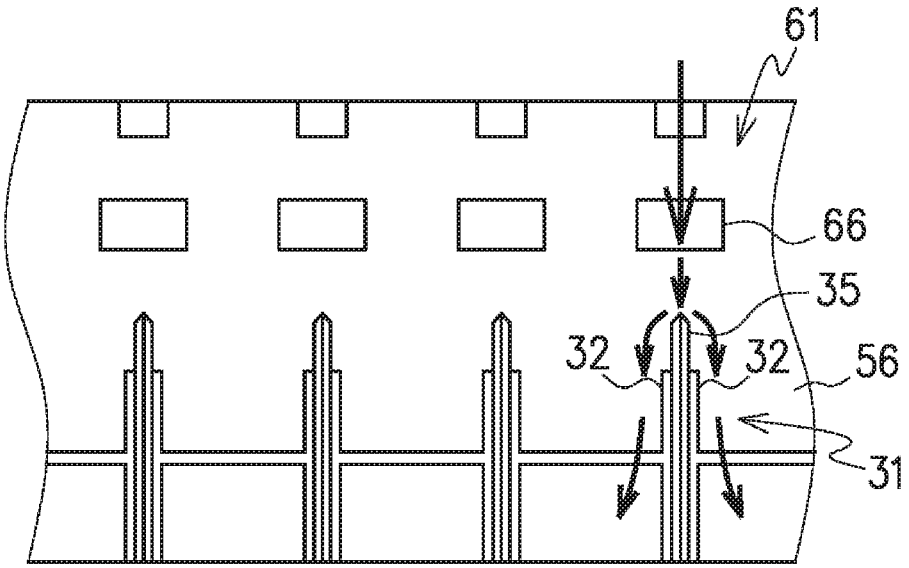
[Fig. 15B]
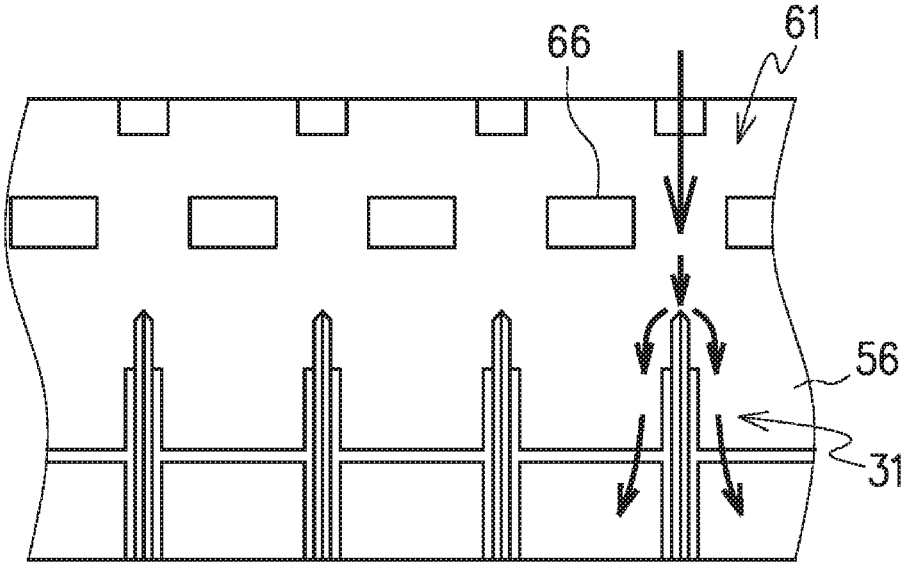

FOAMED WATER DISCHARGING DEVICE AND FOAMED WATER DISCHARGING UNIT

TECHNICAL FIELD

The present invention relates to a foamed water discharging device and a foamed water discharging unit that make finely foamed water from water passing through a water passage and discharge the finely foamed water.

BACKGROUND ART

As conventionally known, in order to reduce the sound of water on a sink, a splash of water against the sink, and other related occurrences, foamed water discharging devices are attached to faucets, water plugs, and similar devices so as to prevent discharged water from spreading. The foamed water discharging devices mix air into part of water inflowing from the faucets, water plugs, or similar devices so as to change part of outflowing water into air bubbles. At the same time, the foamed water discharging devices cause the water to collide with something in the water passage through to a water discharging hole so as to change the water into foamed water.

Patent documents 1 and 2 each disclose a foamed water discharging device that includes: a pressure reducer that is disposed between a water feeding hole and a water discharging hole and that has a plurality of small holes to reduce the pressure of water flowing from the water feeding hole; a ventilation passage that has a plurality of air holes to cause air to be contained in the water outflowing through the pressure reducer; and a rectifier that is disposed on the downstream side of the ventilation passage and that causes the air-containing water to drop along the water passage so as to rectify the discharge direction of the air-containing water toward the water discharging hole.

In the foamed water discharging device disclosed in patent document 1, a stepless, tapered inclined surface is formed in the water passage on the downstream side of the pressure reducer (pressure reducing plate). A sprinkle of water is discharged through the plurality of small holes of the pressure reducing plate and caused to contact external air flowing into the water passage through the ventilation hole, resulting in air bubble water. Then, the air bubble water is dropped along the inclined surface of the water passage and changed into foamed water through the course to the rectifier, which has a lattice-shaped. Then, the foamed water is discharged.

The foamed water discharging device disclosed in patent document 2 includes a pressure reducer that forces out, with increased flowing speed, water inflowing from the water feeding hole toward the downstream side of the water passage. The pressure reducer includes a pressure reducing plate having a plurality of through holes. The water passage has an inclined surface that causes air bubbles to be contained in the water forced out through the pressure reducing plate and that guides the air bubble-containing water toward the center of the water passage. In the water passage, a rectifier is disposed that rectifies the direction of the water outflowing along the inclined surface toward the water discharging hole.

RELATED ART DOCUMENTS

Patent Documents

[Patent document 1] Japanese Patent No. 4474632.

[Patent document 2] Japanese Unexamined Patent Application Publication No. 2012-72594.

DISCLOSURE OF THE INVENTION

Problems to be Solved by the Invention

The foamed water discharging devices disclosed in patent documents 1 and 2 each include the inclined portion with which external-air containing water is caused to collide so as to foam the water whose flowing speed has been increased through the pressure reducing plate. The inclined portion is formed by making the inner circumferential surface of the water passage, which has a cylindrical shape, uniformly inclined into the form of a taper. That is, forming the inclined portion does no more than enlarge the surface to collide with water. Thus, it has been difficult to make more finely foamed water in the course to the rectifier, which is on the downstream side. Additionally, in the conventional foamed water discharging devices, the foamed water is lower in flowing speed, providing degraded washing capabilities.

It is an object of the present invention to provide a foamed water discharging device that divides the flow of air-containing water in effecting a collision so as to make more finely foamed water, and that discharges the more finely foamed water at a flowing speed high enough to increase the washing capabilities.

Means of Solving the Problems

In order to solve the above-described problems, a foamed water discharging device according to the present invention includes a water passage, a foamed water generator, and a ventilation passage. The water passage includes a water feeding hole at one end of the water passage and a water discharging hole at another end of the water passage. The foamed water generator is disposed at the water passage to convert water supplied through the water feeding hole into foamed water. The ventilation passage is disposed on an upstream side of the foamed water generator to take external air into the water passage. The foamed water generator includes a flow dividing rib protruding toward an inside of the water passage. The flow dividing rib includes an edge and a pair of inclined surfaces. The edge extends and is inclined in the water passage toward a downstream side of the water passage. The pair of inclined surfaces are disposed at two sides of the edge.

The flow dividing rib includes side surfaces at two sides of the pair of inclined surfaces, and water receiving ribs protrude from the side surfaces to receive part of divided water.

The water receiving rib includes a receiving surface disposed at a position lower than the pair of inclined surfaces of the flow dividing rib and extending toward the downstream side of the water passage at an inclination angle smaller than an inclination angle of the edge of the flow dividing rib.

A foamed water discharging unit according to the present invention is combined with the above-described foamed water discharging device. The foamed water discharging device is attachably and detachably disposed between a water feeding case communicating with the water feeding hole and a water discharging case communicating with the water discharging hole.

Effects of the Invention

In the foamed water discharging device according to the present invention, a plurality of flow dividing ribs are provided along the inner circumferential surface of the water passage. In order to implement divided flows in multiple directions, each of the flow dividing ribs includes the edge extending and inclined in the water passage toward the downstream side of the water passage; and the pair of inclined surfaces disposed at two sides of the edge. This configuration causes part of the water flowing through the water passage to be divided in multiple directions and to repeat collisions. As a result, the foamed water discharged through the water discharging hole contains an increased number of air bubbles.

The water receiving ribs are provided on two sides of the flow dividing rib to receive part of water divided by the flow dividing rib. This configuration causes the water dropping along the pair of inclined surfaces of the flow dividing rib to undergo collisions in stages by utilizing high-low differences. As a result, the foamed water discharged through the water discharging hole contains an increased number of finer air bubbles.

Additionally, the water receiving rib is provided with the receiving surface whose inclination angle is smaller than the inclination angle of the flow dividing rib. The receiving surface makes lower the flowing speed of a slight amount of water alone when the slight amount of water collides with the receiving surface. This configuration ensures that a gas-liquid boundary is generated efficiently and that the rest part of the jet flow remains undecelerated and is discharged at higher flowing speed, resulting in increased washing capabilities.

BRIEF DESCRIPTION OF THE DRAWINGS

FIG. 1 is a perspective view of an entire structure of a foamed water discharging device according to a first embodiment of the present invention as seen from above.

FIG. 2 is a perspective view of the entire structure of the foamed water discharging device as seen from below.

FIG. 3 is a perspective view of an internal structure of the foamed water discharging device.

FIG. 4 is a sectional view of the foamed water discharging device.

FIG. 5 is a perspective view of a bush constituting a pressure reducer of the foamed water discharging device.

FIG. 6 illustrates a structure of a water passage of the foamed water discharging device.

FIG. 7 is a perspective view of main elements of the water passage of the foamed water discharging device.

FIG. 8 illustrates a gas-liquid boundary generated by a foamed water generator of the foamed water discharging device.

FIG. 9 is a perspective view of main elements of the water passage according to a second embodiment.

FIG. 10 is a perspective view of an internal structure of a foamed water discharging unit combined with the foamed water discharging device according to the first embodiment.

FIG. 11 is a sectional view of the foamed water discharging device with a filter mounted on a water discharging hole.

FIG. 12 is a perspective view of a foamed water discharging device according to the second embodiment of the present invention.

FIG. 13A is a perspective view of a water guiding passage of the foamed water discharging device according to the second embodiment.

FIG. 13B is a sectional view of a water guiding passage of the foamed water discharging device according to the second embodiment.

FIG. 14A is a perspective view of the foamed water generator of the foamed water discharging device according to the second embodiment.

FIG. 14B is a sectional view of the foamed water generator of the foamed water discharging device according to the second embodiment.

FIG. 15A illustrates main elements of the foamed water discharging device according to the second embodiment, illustrating an exemplary positional relationship between flow dividing ribs of the water passage and ventilation windows.

FIG. 15B illustrates main elements of the foamed water discharging device according to the second embodiment, illustrating another exemplary positional relationship between the flow dividing ribs of the water passage and the ventilation windows.

MODE FOR CARRYING OUT THE INVENTION

Embodiments of the foamed water discharging device according to the present invention will be described in detail below by referring to the accompanying drawings. As illustrated in FIGS. 1 to 3, a foamed water discharging device 1 according to the first embodiment of the present invention includes a casing 4, a water feeding hole 2, a water discharging hole 3, a water passage 11, and a ventilation passage 12. The casing 4 is a cylindrical member. The water feeding hole 2 is disposed at one end of the casing 4. The water discharging hole 3 is disposed at another end of the casing 4. The water passage 11 and the ventilation passage 12 are disposed in the casing 4. On the water feeding hole 2 side of the casing 4, a receptacle 5 is disposed. The receptacle 5 is attachable and detachable to and from water sources such as tap water faucets, water plugs, and similar devices. An inner circumferential surface 6 of the receptacle 5 matches the diameter of the water source, and an outer circumference surface 7 of the receptacle 5 is a thick surface with depressions and protrusions, which are provided for ease of mountability. In this embodiment, screw grooves 8 are formed on the inner circumferential surface 6 for the receptacle 5 to be screwed to the water source. It is also possible to make the inner circumferential surface 6 an elastic surface with depressions and protrusions, so that the receptacle 5 can be press-fitted with the water source.

As illustrated in FIGS. 1 to 4, the water passage 11 has an inner circumferential surface whose diameter decreases gradually from the water feeding hole 2 toward the water discharging hole 3. The water passage 11 includes a pressure reducer 13, a foam generator 14, a foamed water generator 15, and a rectifier 16. The pressure reducer 13 reduces the pressure of water inflowing, from the upstream side toward the downstream side, through the water feeding hole 2 from the water source by diminishing the water flow, thereby increasing the flowing speed. The foam generator 14 foams the water past the pressure reducer 13 by causing air to be contained in the water. The foamed water generator 15 converts the water past the foam generator 14 into finely foamed water. The rectifier 16 rectifies the foamed water past the foamed water generator 15 toward the water discharging hole 3. The ventilation passage 12 includes a first external air inlet hole 17*a*, a plurality of second external air inlet holes 17*b*, and ventilation windows 18. The first external air inlet hole 17*a* is a ring-shaped opening at the water discharging hole 3 of the casing 4. The plurality of second external air inlet holes 17*b* are open on the outer circumferential surface of the casing 4 to communicate with the first external air inlet hole 17*a*. The ventilation windows 18 are open toward the water passage 11.

As illustrated in FIG. 5, the pressure reducer 13 includes a bush 23. The bush 23 is made of a resin press-fittable with the water feeding hole 2. The bush 23 includes a larger-diameter portion 21 and a smaller-diameter portion 22. The larger-diameter portion 21 has approximately the same diameter as the diameter of the water feeding hole 2. The smaller-diameter portion 22 is diminished in diameter from the larger-diameter portion 21 to match the inner circumferential surface of the water passage 11. On the outer circumferential surfaces of the larger-diameter portion 21 and the smaller-diameter portion 22, a plurality of stripe-shaped grooves 25 are disposed at equal intervals in the circumferential direction and extend between an upper surface 21*a* of the larger-diameter portion 21 and a lower surface 22*a* of the smaller-diameter portion 22.

Each of the plurality of grooves 25 is a continuous groove made up of a perpendicular portion 25*a*, a bent portion 25*b*, and an inclined portion 25*c*. The perpendicular portion 25*a* has an approximately perpendicular surface along the outer circumferential surface of the larger-diameter portion 21 of the bush 23. The bent portion 25*b* is bent gently between the lower end of the perpendicular portion 25*a* and an upper portion of the smaller-diameter portion 22. The inclined portion 25*c* extends from the lower end of the bent portion 25*b* toward the lower surface 22*a* of the smaller-diameter portion 22 and is inclined inwardly.

As illustrated in FIGS. 1 to 4, the bush 23 with the plurality of grooves 25 on is fitted with the water feeding hole 2 side of the casing 4 to bring the bush 23 into close contact with the water feeding hole 2 side of the casing 4. In this fitting, in order to prevent a leakage of water, a gasket 27 seals the outer circumferential edges of the upper surface 21*a* of the larger-diameter portion 21 of the bush 23.

As a result of the above-described fitting, a plurality of through, water guiding passages 24 are formed between the outer circumferential surface of the bush 23 and the inner circumferential surface of the casing 4. The water guiding passages 24 correspond to the plurality of grooves 25. The flow of water through the water guiding passage 24 is diminished from the perpendicular portion 25*a* through the bent portion 25*b*, and is increased in flowing speed during the downward flow through the inclined portion 25*c*. This configuration causes the water to be forced out toward the downstream side of the water passage 11.

In a conventional foamed water discharging device, such a structure of the pressure reducer is employed that a plurality of small holes are disposed through the casing, from the water feeding hole toward the downstream side of the casing. In the present invention, the plurality of grooves 25 are formed along the outer circumferential surface of the bush 23, and the grooves 25 are in close contact with the inner circumferential surface of the casing 4. This configuration enables more precise, finer hole processing to be performed. Also, the bush 23 is detachable from the casing 4. This configuration enables cleaning to be performed with the parts taken apart. This enables clogging, if any, in the grooves 25 to be eliminated more easily, providing superior maintainability. Additionally, the above configuration optimizes water flow adjustment by adjusting the shape, size, or number of the grooves 25 formed on the bush 23 or by replacing the entire bush 23 itself based on the shape, size, or flow amount of the faucet or a similar device to which the foamed water discharging device 1 is mounted.

In the foam generator 14, which is positioned on the downstream side of the pressure reducer 13, external air is emitted from the ventilation windows 18, which are open toward the inner circumferential surface of the casing 4, and is applied to the water forced out from the plurality of the water guiding passages 24. In this manner, air bubble water, which contains air, is obtained. The ventilation windows 18 are open on the downstream side of the plurality of the water guiding passages 24 and immediately under the plurality of the water guiding passages 24. A flow of air is introduced through the ventilation windows 18 to turn the water emitted through the water guiding passages 24 into air bubble water. The air bubble water flows toward the center of the casing 4 while being scattered on a suitable level.

As illustrated in FIGS. 6 and 7, the foamed water generator 15 includes flow dividing ribs 31. Each of the flow dividing ribs 31 includes an inclined top portion 30. The top portion 30 divides in multiple directions the air bubble water foamed by the foam generator 14. A pair of water receiving ribs 32 abut on each flow dividing rib 31. Each water receiving rib 32 includes a receiving surface 34, with which the air bubble water dropping along the top portion 30 of the flow dividing rib 31 collides to be finely foamed.

Each flow dividing rib 31 is made up of a protrusion piece 29. The protrusion piece 29 is an approximately triangular plate protruding from the inner circumferential surface of the water passage 11. The inclined top portion 30 of the protrusion piece 29 is inclined downward from the inner circumferential surface of the water passage 11 toward the center of the water passage 11. The top portion 30 includes an edge 35 at the center in the longitudinal direction of the top portion 30. The edge 35 is the center of a pair of inclined surfaces 33, which are inclined by a predetermined angle in the rightward and leftward directions. The inclination angle of the pair of inclined surfaces 33, which are centered around the edge 35, is set based on the flowing speed at which the foamed water is discharged. At an acute angle, the flow of water can be divided without decreasing the flowing speed. At an obtuse angle, the flow of water can be divided with lowered water flowing speed. While in the embodiment illustrated in FIGS. 6 and 7 the inclined surfaces 33 come in pairs on the flow dividing ribs 31, more than a pair of inclined surfaces 33 may form a plurality of steps each having a different inclination angle. The flow dividing ribs 31 disperse the flow of water in multiple directions to cause collisions, thereby converting water into foamed water. The flow of water may not necessarily be divided uniformly in the directions along the pair of inclined surfaces 33; the flow of water may also be divided in the frontward and rearward directions.

The pair of water receiving ribs 32 include the receiving surfaces 34. The receiving surfaces 34 receive, at positions lower than the inclined surfaces 33, the water divided by the pair of inclined surfaces 33 of the flow dividing rib 32. The receiving surfaces 34 protrude from two side surfaces of the flow dividing rib 31 at an inclination angle smaller than the inclination angle of the top portion 30 of the flow dividing rib 31. This configuration ensures that the water divided by the flow dividing rib 31 is guided toward a cylindrical rib 36, which is provided for rectifying purposes, with the flowing speed of the water lowered. As a result, more finely foamed water is obtained.

The water that passes through the plurality of flow dividing ribs 31 and the plurality of water receiving ribs 32 constitutes approximately from 30 percent to 40 percent of the water that flows through the water passage 11 as a whole. The 30 to 40-percent water undergo more collisions in the water passage 11 than when guided directly to the cylindrical rib 36 from the foam generator 14, since the water flows in varying directions and passes through such elements as the flow dividing ribs 32, the water receiving ribs 32, and the cylindrical rib 36. Each of the plurality of flow dividing ribs 31 uses the edge 35 to cut the water forced out from the upstream side so as to divide the water toward the adjacent, right and left water receiving ribs 32. This configuration further promotes collisions of the water in the course toward the water discharging hole 3, from the cylindrical rib 36 through vertical ribs 37.

As illustrated in FIG. 7, the rectifier 16 includes the cylindrical rib 36 and the plurality of vertical ribs 37. The cylindrical rib 36 connects the downstream-side ends of the flow dividing ribs 31 and the water receiving ribs 32 together in a ring-shaped manner. The plurality of vertical ribs 37 extend from the cylindrical rib 36 toward the water discharging hole 3. The cylindrical rib 36 includes an inner cylindrical portion 36*a* and an outer cylindrical portion 36*b*. The inner cylindrical portion 36*a* abuts on the lower ends of the top portions 30 of the flow dividing ribs 31. The outer cylindrical portion 36*b* is disposed on the outside of the inner cylindrical portion 36*a* and is concentric to the inner cylindrical portion 36*a*. Between the inner cylindrical portion 36*a* and the outer cylindrical portion 36*b*, partitions radially extend to define a lattice surface. From the inner cylindrical portion 36*a*, foamed water is discharged at a flowing speed lowered through the flow dividing ribs 31 and the water receiving ribs 32. From the outer cylindrical portion 36*b*, foamed water is discharged at a higher flowing speed. The amount of the discharged foamed water is larger through the outer cylindrical portion 36*b* than through the inner cylindrical portion 36*a*.

FIG. 8 illustrates a state of a gas-liquid boundary C at the rectifier 16. On the upstream side of the cylindrical rib 36, the water guided by the receiving surfaces 34 of the water receiving ribs 32 causes the gas-liquid boundary C to be generated to serve as a boundary region between a gas phase A and a liquid phase B. On the gas-liquid boundary C, flows of water dropping through the water passage 11 collide with each other while covering the opening of the cylindrical rib 36. This configuration ensures that the water discharged through the water discharging hole 3 is more finely foamed water.

In this embodiment, the flow dividing ribs 31 and the water receiving ribs 32 are provided at positions that divide the inner circumferential surface of the casing 4 uniformly in six. Additionally, the cylindrical rib 36 is provided. This structure causes the jet flow refined at the flow dividing ribs 31 and the cylindrical rib 36 to take in air around the jet flow at the time of collision with the liquid phase formed by the receiving surfaces 34 of the water receiving ribs 32, resulting in more finely foamed water discharged through the water discharging hole. As illustrated in FIG. 8, it is the slight amount of water flowing onto the receiving surfaces 34 of the water receiving ribs 32 alone that is lowered in flowing speed when the gas-liquid boundary C is generated. This configuration ensures that the speed of the jet flow as a whole remains undecelerated and is discharged at flowing speed, resulting in increased washing capabilities. The flow dividing ribs 31 and the water receiving ribs 32 may be provided based on the diameter or number of the water guiding passages 24, which are disposed in the pressure reducer 13. In this manner, the flowing speed or amount of the foamed water discharged through the water discharging hole 3 can be adjusted.

In the water passage 11, the ventilation windows 18, through which external air is guided, are positioned immediately above the respective flow dividing ribs 31. That is, the ventilation windows 18 are positioned on linear passages connecting the water guiding passages 24 of the pressure reducer 13 to the top portion 30 of the flow dividing ribs 31. This configuration causes external air to directly contact the water dropping toward the flow dividing ribs 31. As a result, the generated foamed water contains an increased number of air bubbles.

FIG. 9 illustrates a structure of the water passage 11*b* according to the second embodiment. In this embodiment, the openings of the ventilation windows 18, which guide external air into the water passage 11*b*, are displaced from the positions immediately above the respective flow dividing ribs 31. That is, the openings of the ventilation windows 18 are positioned to avoid the passages for the water flowing from the water guiding passages 24, which are disposed in the pressure reducer 13, toward the top portions 30 of the flow dividing ribs 31. Thus, the ventilation windows 18 are displaced in the rightward direction or the leftward direction from linear passages connecting the water guiding passages 24 to the top portions 30 of the flow dividing ribs 31. This configuration makes a leakage of water through the ventilation windows 18 more difficult to occur when there is a filter, a watering plate of a shower, or some other pressure loss source on the downstream side of the water discharging hole 3.

In this embodiment, the opening positions of the ventilation windows 18 are displaced to avoid overlapping with the passages for the water flowing from the water guiding passages 24 toward the top portions 30 of the flow dividing ribs 31. It is also possible to adjust the amount of air bubbles to be contained based on the distance by which one end of the opening of the ventilation window 18 is spaced apart from the top portion 30 of the flow dividing rib 31.

Also, in the ventilation passage 12, in which the ventilation windows 18 are disposed, flow amount adjusting means for adjusting the amount of external air to be introduced into the water passage 11*b* may be disposed. The flow amount adjusting means ensures setting of the size and amount of air bubbles to be contained in the foamed water generated through the flow dividing ribs 31.

FIG. 10 illustrates an exemplary combination of a foamed water discharging unit 71, such as a shower head, and the foamed water discharging device 1. The foamed water discharging unit 71 includes a water feeding case 72 and a water discharging case 73. The water feeding case 72 is connected to a water feeding hole of a water plug through a hose or a similar device. The water discharging case 73 includes a plurality of discharge holes 75, through which a shower of water is discharged. The foamed water discharging device 1 according to this embodiment includes an outer diameter portion 74. The outer diameter portion 74 is held between the water feeding case 72 and the water discharging case 73 via an elastic member 76, such as an O-ring.

In the foamed water discharging unit 71, routes communicating with the ventilation passage 12 of the foamed water discharging device 1 are: the plurality of discharge holes 75, which are disposed on the water discharging case 73; and the connection portion at which the water feeding case 72 and the water discharging case 73 are combined with each other via the elastic member 76. The elastic member 76, which is interposed at the connection portion, functions as the flow amount adjusting means. This configuration ensures that by loosening and tightening the engagement between the water feeding case 72 and the water discharging case 73, the diameter and width of the ventilation passage 12 of the foamed water discharging device 1 are regulated, enabling the amount of external air guided into the water passage 11*b* to be conveniently changed. Thus, the amount of air bubbles to be contained in the water foamed by the flow dividing ribs 31 can be adjusted, and the air bubbles can be refined by adjusting the amount of external air inflowing through the ventilation windows 18.

Also as illustrated in FIG. 11, by providing a porous filter 38 on the water discharging hole 3, the water discharged through the water discharging hole 3 is made foamed water containing finer, micro-level air bubbles. The filter 38 is made up of a stack of equal to or more than three layers of meshed members each having a large number of fine holes.

Next, a foamed water discharging device according to the second embodiment of the present invention will be described by referring to FIGS. 12 to 15. The foamed water discharging device 51 according to this embodiment, in order to discharge wide, film-shaped water, the foamed water discharging device 51 is made up of a casing 54, which is a cylindrical member that includes planar portions 58*a* and 58*b* at least on a part of the inner circumferential surface. The casing 54 is made up of the pair of planar portions 58*a* and 58*b* and a pair of arcuate corner portions 59. The pair of planar portions 58*a* and 58*b* are opposed to each other and extend in the longitudinal direction. The corner portions 59 connect two ends of the planar portion 58*a* with two ends of the planar portion 58*b*. The casing 54 defines a flat water passage 61. At one end of the water passage 61, a water feeding hole 52 is disposed. At another end of the water passage 61, a water discharging hole 53 is disposed. In a middle of the water passage 61, a ventilation passage 62 is disposed. Based on the gap between the pair of planar portions 58*a* and 58*b*, which are opposed to each other, the film thickness of the film-shaped discharged water is set. In this embodiment, for smooth flow at the two ends of the water passage 61, the corner portions 59 are arcuate. The corner portions 59 may alternatively have square shapes orthogonal to the pair of planar portions 58*a* and 58*b*. As illustrated in FIG. 12, the casing 54 is mounted in a flat discharge head 55 and connected with a converter (not illustrated) that is used to feed water toward the water feeding hole 52 from a common, circular tap water faucet, water plug, or similar device.

As illustrated in FIGS. 13A and 13B, similarly to the water passage 11 according to the first embodiment, the water passage 61 includes a pressure reducer 63, a foam generator 64, a foamed water generator 65, and a rectifier 69. The pressure reducer 63 includes water guiding passages 68. The water guiding passages 68 are made up of a plurality of stripe-shaped grooves formed on the water feeding hole 52 side. The foam generator 64 brings external air into contact with water dropping from the water guiding passages 68 so as to foam the water. The foamed water generator 65 converts the water past the foam generator 64 into finely foamed water. The rectifier 69 rectifies the foamed water past the foamed water generator 65 toward the water discharging hole 53. Also, the ventilation passage 62 includes a plurality of ventilation windows 66, which penetrate through the one planar portion 58*a*.

The pressure reducer 63 includes a flat bush fittable with the water feeding hole 52. On the one planar portion 58*a* and a part of the corner portion 59 that is in contact with the bush, a plurality of stripe-shaped grooves 67, which extend from the upstream side toward the downstream side, are disposed at equal intervals. The grooves 67 define the water guiding passages 68, which extend toward the foamed water generator 65 through the foam generator 64.

As illustrated in FIGS. 14A, 14B, 15A, and 15B, the water passage 61, which is on downstream side of the water guiding passages 68, includes flow dividing ribs 31. Each of the flow dividing ribs 31 is disposed in an orthogonal direction from the one planar portion 58*a* to the other planar portion 58*b* of an inner circumferential surface 56 of the casing 54 to divide in multiple directions air bubble water foamed by external air introduced through the ventilation windows 66. A pair of water receiving ribs 32 abut on each flow dividing rib 31. Each water receiving rib 32 includes a receiving surface 34, with which the air bubble water dropping along the top portion 30 of the flow dividing rib 31 collides to be finely foamed. Except that the flow dividing ribs 31 and the water receiving ribs 32 are aligned in plural in an orthogonal direction from the one planar portion 58*a* of the inner circumferential surface of the casing 54, details of the flow dividing ribs 31 and the water receiving ribs 32 are similar to the first embodiment described above and will not be elaborated.

As illustrated in FIG. 15A, the ventilation window 66 is disposed on a line connecting the water guiding passage 68 with the top portion 30 of the flow dividing rib 31. This configuration ensures that the obtained foamed water contains an increased number of air bubbles, similarly to the water passage 11 according to the first embodiment. In contrast, as illustrated in FIG. 15B, the ventilation window 66 is disposed at a position displaced from a line connecting the water guiding passage 68 with the top portion 30 of the flow dividing rib 31. This configuration makes a leakage of water through the ventilation windows 66 more difficult to occur when there is a filter, a watering plate of a shower, or some other pressure loss source on the downstream side of the water discharging hole 3 (see FIGS. 13 and 14).

Also, flow amount adjusting means for adjusting the amount of external air may be disposed in the ventilation passage 62, which communicates with the ventilation windows 66. The flow amount adjusting means ensures setting of the size and amount of air bubbles to be contained in the water flowing toward the foamed water generator 65 from the water guiding passages 68. The flow amount adjusting means may be implemented by, as described above, an O-ring or some other elastic member that expands and contracts based on changes in the diameter of the ventilation passage 62 or by a shutter or a similar device that opens and closes slidably along the ventilation windows 66. Further, the filter 38 illustrated in FIG. 11 may be provided in a shape corresponding to the water discharging hole 53. This configuration ensures that the foamed water discharged through the water discharging hole 53 is made foamed water containing finer, micro-level air bubbles.

Thus, the foamed water discharging device 51 according to this embodiment, in order to discharge wide, film-shaped foamed water through the water discharging hole 53, the casing 54 has a flat shape for the water passage 61 from the water feeding hole 52 to the water discharging hole 53. Except for this configuration, the foamed water discharging device 51 has a structure similar to the foamed water discharging device 1 according to the first embodiment. In this embodiment, the water passage 61, which is made up of elements such as the water guiding passages 68, the ventilation windows 66, and the flow dividing ribs 31, is formed along the one planar portion 58*a* of the inner circumferential surface of the casing 54. The water passage 61 may alternatively be formed along the other planar portion 58*b*. It is also possible to form similar water passages 61 both on the pair of planar portions 58*a* and 58*b* insofar as elements such as the water guiding passages 68, the ventilation windows 66, and the flow dividing ribs 31 do not overlap each other and are opposed to each other.

The foamed water discharging unit 71 illustrated in FIG. 10 is an exemplary application of the foamed water discharging device 1 according to the first embodiment to a shower head accommodating to the cylindrical shape of the foamed water discharging device 1. It is also possible to change the shapes of the water feeding case and the water discharging case into flat shapes so as to accommodate to the shape of the foamed water discharging device 51 according to the second embodiment and implement a discharge head that discharges wide, film-shaped water.

DESCRIPTION OF THE REFERENCE NUMERAL

A Gas phase
B Liquid phase
C Gas-liquid boundary
1 Foamed water discharging device (first embodiment)
2 Water feeding hole
3 Water discharging hole
4 Casing
5 Receptacle
6 Inner circumferential surface
7 Outer circumference surface
8 Screw groove
11 Water passage (first embodiment)
11*b* Water passage (second embodiment)
12 Ventilation passage
13 Pressure reducer
14 Foam generator
15 Foamed water generator
16 Rectifier
17*a* First external air inlet hole
17*b* Second external air inlet hole
18 Ventilation window
21 Larger-diameter portion
21*a* Upper surface
22 Smaller-diameter portion
22*a* Lower surface
23 Bush
24 Water guiding passage
25 Groove
25*a* Perpendicular portion
25*b* Bent portion
25*c* Inclined portion
27 Gasket
29 Protrusion piece
30 Top portion
31 Flow dividing rib
32 Water receiving rib
33 Inclined surface
34 Receiving surface
35 Edge (ridge)
36 Cylindrical rib
37 Vertical rib
38 Filter
51 Foamed water discharging device (second embodiment)
52 Water feeding hole
53 Water discharging hole
54 Casing
55 Discharge head
56 Inner circumferential surface
58*a*, 58*b* Planar portion
59 Corner portion
61 Water passage
62 Ventilation passage
63 Pressure reducer
64 Foam generator
65 Foamed water generator
66 Ventilation window
67 Groove
68 Water guiding passage
69 Rectifier
71 Foamed water discharging unit
72 Water feeding case
73 Water discharging case
74 Outer diameter portion
75 Discharge hole
76 Elastic member

The invention claimed is:

1. A foamed water discharging device comprising:

a casing being a cylindrical member;

a water passage disposed in the casing and comprising a water feeding hole at one end of the casing and a water discharging hole at another end of the casing;

a foamed water generator disposed at the water passage to convert water supplied through the water feeding hole into foamed water; and a ventilation passage disposed on an upstream side of the foamed water generator to take external air into the water passage, the foamed water generator comprising a flow dividing rib and a water receiving rib, the flow dividing rib protruding toward an inside of the water passage, the flow dividing rib being made up of an approximately triangular shape of a protrusion piece protruding from an inner circumferential surface of the water passage toward a center of the water passage, and the flow dividing rib comprising a top portion and side surfaces, the top portion inclined downward from the upstream side of the water passage toward a downstream side of the water passage, and the top portion comprising an edge at the center of the top portion and a pair of inclined surfaces at two sides of the edge, the edge extending and inclined downward from the upstream side of the water passage to the downstream side of the water passage; and the pair of inclined surfaces inclined from the edge at a predetermined angle, one of the pair of inclined surfaces inclined in rightward direction from the edge and another of the pair of inclined surfaces inclined in leftward direction from the edge, the side surfaces disposed on the left and right of the flow dividing rib and extending downward from the pair of inclined surfaces;

the water receiving rib formed by protruding from each of the side surfaces of the flow dividing rib and configured to receive part of divided water, the water receiving rib comprising a receiving surface disposed at a position lower than the pair of inclined surfaces of the flow dividing rib, and the receiving surface extending toward the downstream side of the water passage at an inclination angle smaller than an inclination angle of the edge of the flow dividing rib.

2. The foamed water discharging device according to claim 1, wherein the water passage comprises the cylindrical member comprising a circular inner circumferential surface, and wherein the flow dividing rib comprises a plurality of flow dividing ribs protruding from the inner circumferential surface of the cylindrical member toward the center of the water passage.

3. The foamed water discharging device according to claim 1, wherein the water passage comprises a cylindrical member comprising a planar portion at a portion of an inner circumferential surface of the cylindrical member, and wherein the flow dividing rib comprises a plurality of flow dividing ribs protruding from the planar portion of the inner circumferential surface of the cylindrical member in a direction orthogonal to the planar portion.

4. The foamed water discharging device according to claim 1, further comprising a pressure reducer in the water passage between the water feeding hole disposed at the one end of the casing and the ventilation passage to increase a flowing speed of the water supplied through the water feeding hole.

5. The foamed water discharging device according to claim 4, wherein the pressure reducer comprises a bush fitted in the water feeding hole disposed at the one end of the casing, and wherein a water guiding passage is disposed on an outer circumferential surface of the bush to guide the water supplied through the water feeding hole to the water passage on a downstream side of the bush.

6. The foamed water discharging device according to claim 5, wherein the bush comprises a larger-diameter portion fitted in the water feeding hole, and a smaller-diameter portion comprising a diameter smaller than a diameter of the larger-diameter portion and fittable with an inner circumferential surface of the water passage, and wherein the water guiding passage comprises a stripe-shaped groove formed on the outer circumferential surface of the bush between the larger-diameter portion and the smaller-diameter portion.

7. The foamed water discharging device according to claim 6, wherein the stripe-shaped groove comprises a plurality of stripe-shaped grooves along the outer circumferential surface of the bush.

8. The foamed water discharging device according to claim 5, wherein the casing comprises a ventilation window to take external air into the water passage, the ventilation window being open between the water guiding passage and the flow dividing rib.

9. The foamed water discharging device according to claim 8, wherein the ventilation window is disposed at a position on a linear passage connecting the water guiding passage to the top portion of the flow dividing rib.

10. The foamed water discharging device according to claim 8, wherein the ventilation window is disposed at a position displaced in a rightward direction or a leftward direction from a linear passage connecting the water guiding passage to the top portion of the flow dividing rib.

11. The foamed water discharging device according to claim 1, wherein the ventilation passage comprises an elastic member that regulates a diameter and a width of the ventilation passage for adjusting an amount of external air to be taken into the water passage.

12. The foamed water discharging device according to claim 1, wherein a filter is disposed between the foamed water generator and the water discharging hole, the filter comprising a stack of meshed members each comprising a plurality of fine holes.

13. A foamed water discharging unit combined with the foamed water discharging device according to claim 1, the foamed water discharging device being attachably and detachably disposed between a water feeding case communicating with the water feeding hole and a water discharging case communicating with the water discharging hole.

14. The foamed water discharging unit according to claim 13, wherein flow amount adjusting means for adjusting an amount of external air to be taken into the water passage between the water feeding hole and the water discharging hole is disposed between the water feeding case and the water discharging case.

15. The foamed water discharging device according to claim 3, wherein the cylindrical member defining the water passage comprises a ventilation window for the ventilation passage to take external air into the water passage.

* * * * *